US006286832B1

(12) United States Patent
Willers

(10) Patent No.: US 6,286,832 B1
(45) Date of Patent: Sep. 11, 2001

(54) CRICKET BOARD GAME

(76) Inventor: David Willers, c/o Alexander's Ltd., Shop 24, Twin Gates Plaza, 25 Constant Spring Road, Kingston 10 (JM)

( * ) Notice: Subject to any disclaimer, the term of this patent is extended or adjusted under 35 U.S.C. 154(b) by 0 days.

(21) Appl. No.: 09/432,769

(22) Filed: Nov. 3, 1999

(51) Int. Cl.[7] ..... A63F 3/00

(52) U.S. Cl. ..... 273/236; 273/259; 273/277; 273/287

(58) Field of Search ..... 273/236, 244, 273/244.1, 244.2, 259, 277, 287, 148 R, 148 A, FOR 259, FOR 277

(56) References Cited

U.S. PATENT DOCUMENTS

| | | | |
|---|---|---|---|
| D. 144,435 | * | 4/1946 | Woofter . |
| 3,524,645 | * | 8/1970 | Breslow . |
| 3,854,720 | * | 12/1974 | Duvall . |
| 4,179,123 | * | 12/1979 | Tsukuda . |
| 4,877,244 | * | 10/1989 | Burrows . |
| 5,183,266 | * | 2/1993 | Kohler . |
| 5,407,204 | * | 4/1995 | Meyer . |
| 5,655,767 | | 8/1997 | Francis et al. . |
| 5,884,914 | | 3/1999 | Lilien . |
| 6,032,954 | * | 3/2000 | Fotter . |
| 6,095,524 | * | 8/2000 | Richter . |

FOREIGN PATENT DOCUMENTS

| | | | |
|---|---|---|---|
| 24548/77 | | 10/1978 | (AU) . |
| 36399/78 | | 11/1979 | (AU) . |
| 2000034 | * | 6/1978 | (GB) . |
| 2 000 034 | | 1/1979 | (GB) . |
| 2114899 | * | 1/1983 | (GB) . |
| 2 172 512 A | | 9/1986 | (GB) . |
| 2 184 028 A | | 6/1987 | (GB) . |
| 2341555 | * | 9/1998 | (GB) . |

* cited by examiner

*Primary Examiner*—Benjamin H. Layno
*Assistant Examiner*—Vishu Mendirattra
(74) *Attorney, Agent, or Firm*—Pepper Hamilton LLP

(57) ABSTRACT

A cricket board game includes an optional matting representing a cricket pitch, the matting which is laid out on a flat surface representing the cricket field. Two wickets are set up at opposing ends of the cricket pitch. A plurality of player cards held by holding mechanisms, which depict each of the cricket players on each of the two sides in the cricket game, are disposed around the cricket field in accordance with the rules of a real cricket game. The player cards, in a preferred embodiment, depict cricket players either pictorially, photographically, or by written description on one side face of the cards. On the other side face of the cards, the players cards have a logo, graphic design, or other representation. The first player acts as the bowler for the first side, and bowls a small ball to the second player, who holds a small bat and acts as a batsman for the second side. The second player hits the ball and the outcome of the play is decided using a scoring diagram which determines the runs depending on both the trajectory and distance that the ball travels, and using a written instruction pamphlet which discloses the rules of the game in accordance with real cricket game rules, and special rules of the cricket game of the present invention.

23 Claims, 4 Drawing Sheets

CRICKET BOARD GAME

The present invention relates to an apparatus and method for playing a board game of cricket.

BACKGROUND OF THE INVENTION

In conventional cricket board games, the outcome of each play is determined using dice and decision cards (i.e., Gerrand et al, GB 2 172 512 and Hooper GB 2 184 028), etc.

In a conventional cricket board game which involves the use of a ball instead of dice, such as Francis et al, U.S. Pat. No. 5,655,767, the game is played using a game board with playing members which are moved by horizontal rod mechanisms along a slotted track, so that the playing members can manipulate a small puck or ball using an object manipulating portion pivotally connected to the main upwardly extending body portion of the playing member. In Francis et al, the ball can be struck or rolled towards the batsman by means of a movable striking member, which is in the form of a pin member.

However, Francis et al, like the other conventional cricket board games, does not allow the participation of each player in the way that a real cricket game is played.

Thus, the cricket board games such as those of Gerrand et al and Hooper suffer from the disadvantages of utilizing dice and decision cards which are complex and lose the spontaneity of a real cricket game; whereas, the manipulated playing members of cricket board games such as those in Francis et al, are provided in a complex mechanical apparatus that is costly to produce.

SUMMARY OF THE INVENTION

It is an object of the present invention to provide an apparatus and a method for playing a board game of cricket, which is inexpensive to produce, and allows the players to achieve the spontaneity of a real cricket game.

The cricket board game of the present invention includes a matting representing a cricket pitch, the matting which is laid out on a flat surface representing the cricket field. Two wickets are set up at opposing ends of the cricket pitch. A plurality of player cards held by holding mechanisms, which depict each of the cricket players on both sides of the cricket game, are disposed around the cricket field in accordance with the rules of a real cricket game. The player cards, in a preferred embodiment, depict cricket players either pictorially, photographically, or by written description on one face of the cards. On the other face of the cards, the player cards have a logo, graphic design, or other representation.

The first player acts as the bowler for the first side, and bowls a small ball to the second player, who holds a small bat and acts as a batsman for the second side. The second player hits the ball and the outcome of the play is decided using a scoring diagram which determines the runs depending on both the trajectory and distance that the ball travels, and using a written instruction pamphlet which discloses the rules of the game in accordance with real cricket game rules, and special rules of the present invention, which relate to whether the ball hits the player cards, etc.

BRIEF DESCRIPTION OF THE DRAWINGS

The above objectives and advantages of the present invention will become more apparent by describing in detail the preferred embodiment thereof, with reference to the attached drawings in which.

DETAILED DESCRIPTION OF THE PREFERRED EMBODIMENTS

The present invention relates to an apparatus and a method for playing a board game of cricket. In the preferred embodiment, a cricket match is played between at least two players (i.e., a first player and a second player), one player for each side. Each player has a total of eleven player cards, representing the cricket team for that side.

Figure 1:
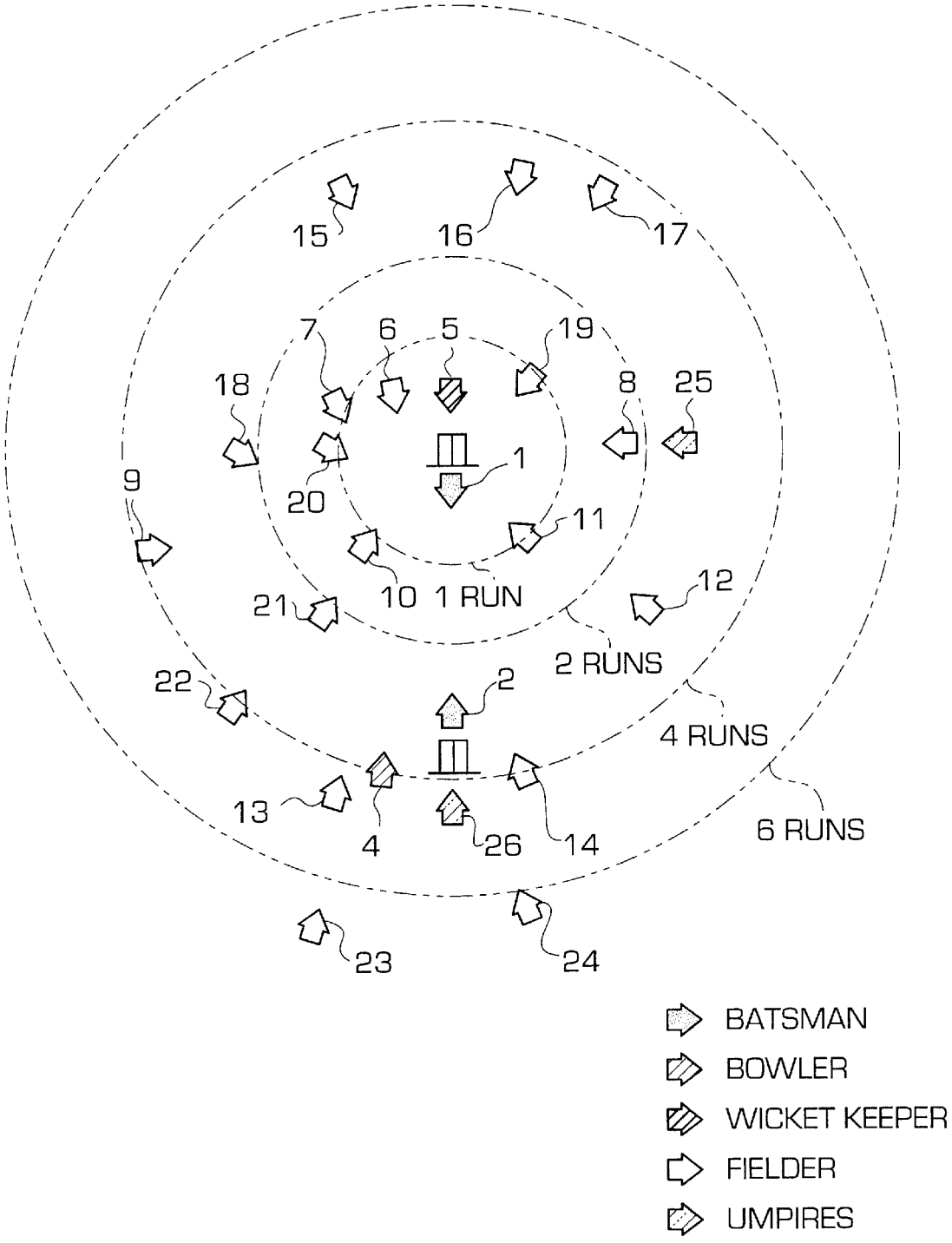
FIG. 1 shows a schematic view of a set up of a cricket field in a real cricket game, overlaid with a scoring diagram according to a preferred embodiment of the present invention.

The cricket field is set up like a cricket field as in the real cricket game, as shown in FIG. 1. When the players, whom are designated by arrows pointing in the direction that the players are looking, are on the field, the first player for the first side has two batsmen 1, 2 on the cricket pitch at each wicket 3, with the other nine players on the sidelines, and the second player for the second side has a bowler 4, wicket keeper 5, and nine other field players situated as shown in FIG. 1, at any of the 19 field positions. As can be seen from FIG. 1, the nine field players for the second side are positioned at, for example, first slip 6, second slip 7, square leg 8, cover point 9, silly mid-off 10, silly mid-on or forward short leg 11, mid-wicket 12, mid-off 13, and mid-on 14. The remaining ten open positions for the nine field players of the second side are third man 15, deep fine leg 16, long leg 17, backward point 18, short fine leg or leg slip 19, gully 20, short extra cover 21, extra cover 22, long-off 23, and long-on 24. Umpires 25, 26 are positioned on the cricket field as shown in FIG. 1.

Figure 2:
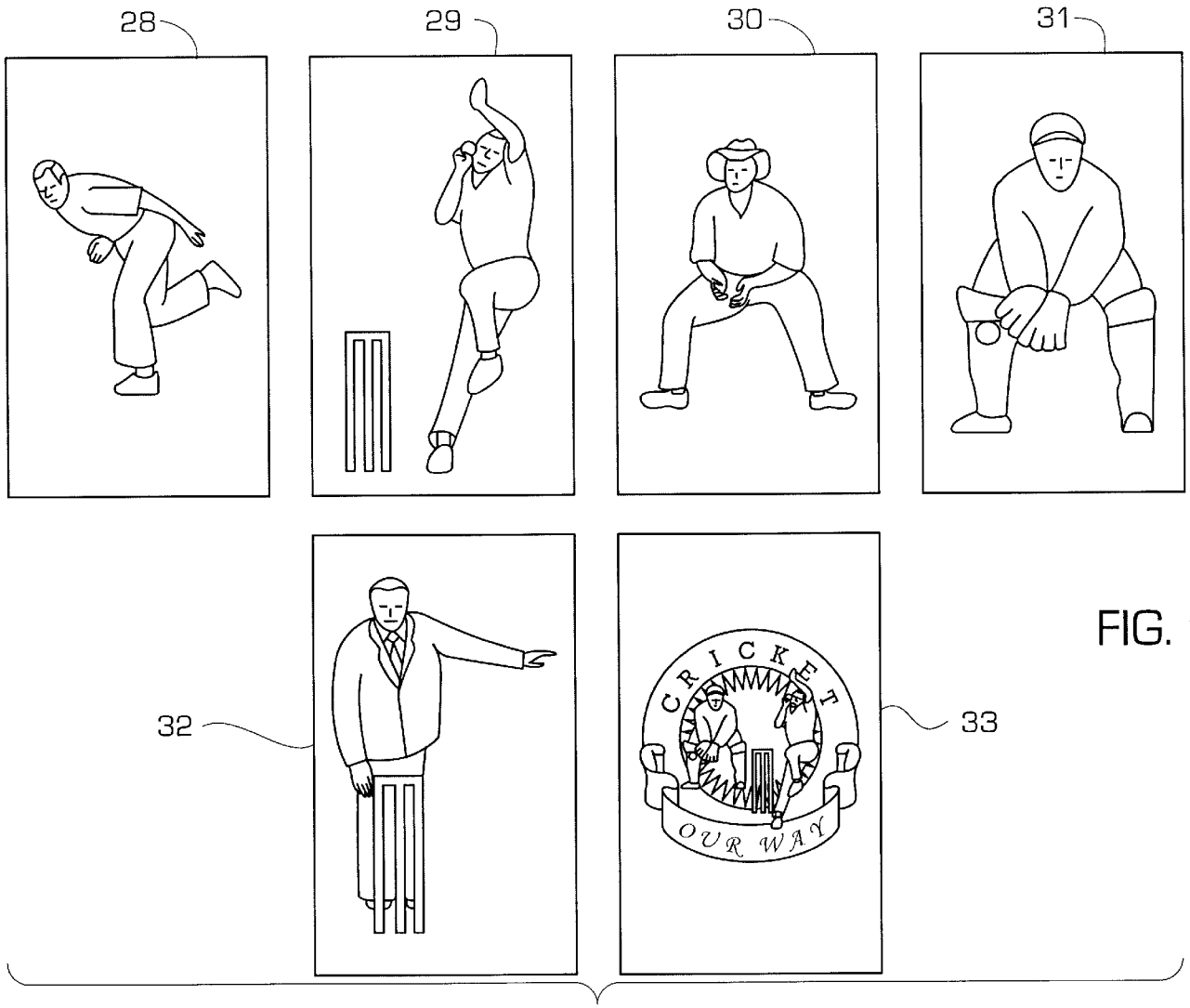
FIG. 2 shows a plan view of representative player cards of the cricket game according to the present invention.
Figure 3:
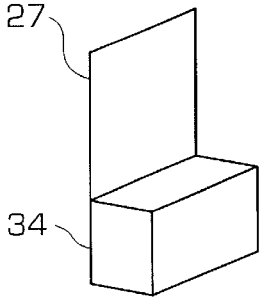
FIG. 3 shows a perspective view of one embodiment of a base to support a player card of the cricket game of the present invention.
Figure 6:
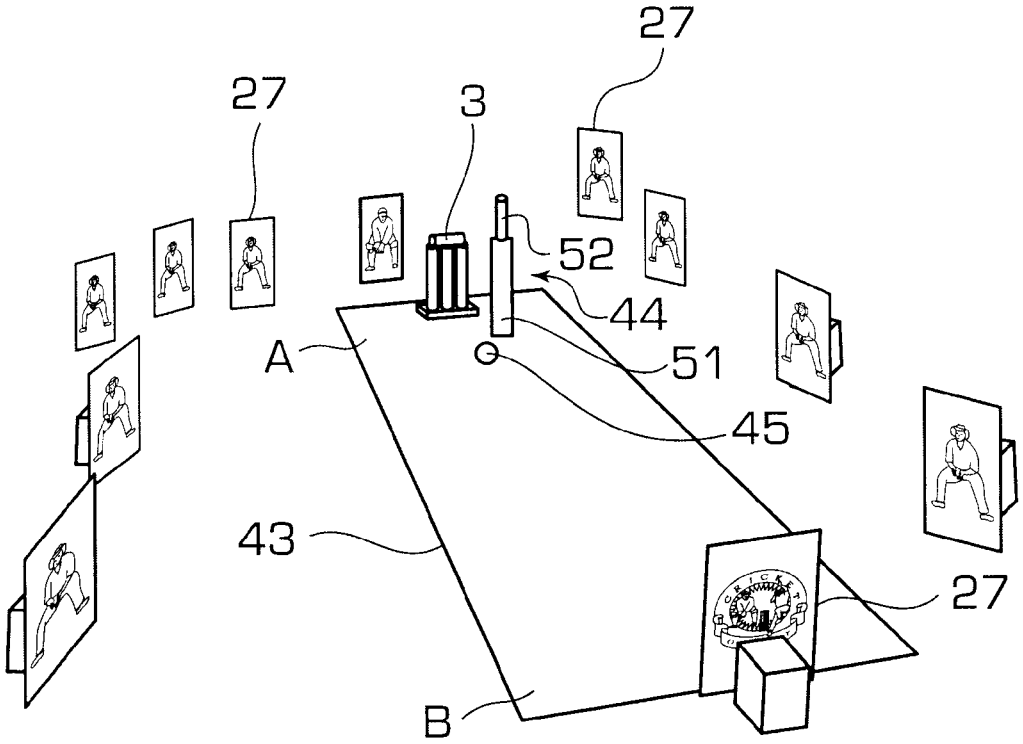
FIG. 6 shows a perspective view of a layout of the cricket game according to a preferred embodiment of the present invention.

The player cards 27, shown in FIGS. 3 and 6, should depict each of the eleven players of each side and their positions on the field. At the very least, the player cards 27 should include a photographic or pictorial representation, or a written description, of the bowler 28 or 29, wicket keeper 30, a field player 31 (which can be general enough to depict or describe any one of the 19 possible fielding positions), and an umpire 32, as shown pictorially, for example, in FIG. 2, on one side face of the cards. However, the player cards 27 can have photographs or other pictorial representations of current, past, or fictional cricket players on the one side face of the cards. The other side face 33 of the cards can have a logo (as shown in FIG. 2), pictorial or photographic representation, written description, or graphic design, as well as individual player statistics.

The player cards 27 can also be blank, either on the side face having the representations of the cricket players, or both side faces of the cards 27, with the game players themselves adhering or fastening any photographic or pictorial representation, or written description of, for example, a current cricket team from a particular country, onto the player cards 27.

The player cards 27 are configured such that they are made of a heavy paper or plastic material, about 4 inches L by 2½ inches W, in size, and are supported by a base (see FIGS. 3–5) made of wood or plastic, or other suitable material. However, the size of the player cards 27 and the supporting base can be changed depending on the scale of the cricket game.

Figure 4:
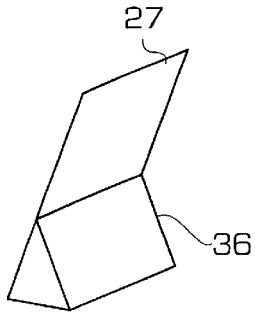
FIG. 4 shows a perspective view of another embodiment of a base to support a player card of the cricket game of the present invention.

The base, in one embodiment shown in FIG. 3, is a wood block 34 about 1½ inches square (but which can also be rectangular), against which the player card 27 is supported. The player card 27 can also be supported against a triangular-shaped wooden portion 36, 1½ inches in length, height, and width, as shown in FIG. 4.

Figure 5:
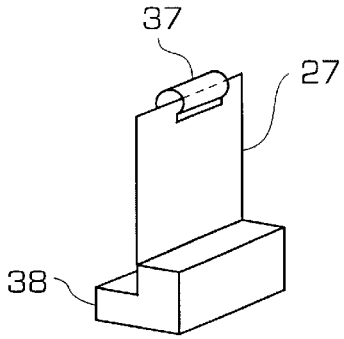
FIG. 5 shows a perspective view of still another embodiment of a base to support a player card of the cricket game of the present invention.

In yet another embodiment shown in FIG. 5, the wooden base 38 is L-shaped, and the player card 27 leans against the vertical portion of the "L".

The above embodiments are illustrative, and it can easily be seen that other types of suitable bases can also be used to support the player cards 27 in any suitable fashion, yet which will allow the card to be easily knocked down when hit by the ball 45 (see below).

If the player cards 27 are blank, fastening mechanisms (i.e., adhesive, clips, etc.) 37 can be used to adhere or fasten the photographic, pictorial, or other representations of players or logos, to the player cards 27 themselves (see, for example, FIG. 5).

The playing surface can be a table top, the floor, or any other flat surface.

A matting 43 (see FIG. 6), made of plastic, or any other suitable material, is optionally placed on the playing surface to represent the cricket pitch. The matting 43 is sized at 36" L×10" W, but can be changed depending on the scale of the playing cards 27, wicket 3, bat 44, and ball 45, used in the cricket game. The matting 43 provides a non-slip surface for the bounce of the ball 45 during play, as well as delineating the measurements of the cricket pitch.

Figure 7:
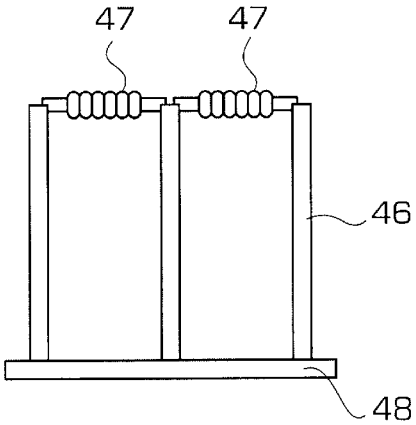
FIG. 7 shows a side view of a wicket of a cricket game according to a preferred embodiment of the present invention.

Two wickets 3 (see FIG. 6) are used in the cricket game. The wickets are disposed at opposing ends of the matting 43, or if no matting 43 is used, are disposed about 36 inches apart. The wickets 3 are each made of three stumps 46 (see FIG. 7), two bails 47 which fit across the top of the stumps 46, and a base 48 into which the stumps 46 are disposed. The wickets 3 are made of wood or plastic or any suitable material, and are approximately 3 inches in height. The bails 47 are the same size, each approximately 1 and a half inches in length, and each bail 47 is placed, not adhered, between two stumps 47, as is usual in cricket. The bails 47 are also made of wood, plastic, or any suitable material.

Figure 8:
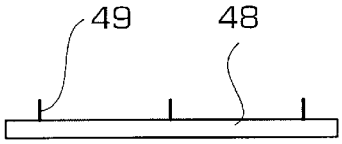
FIG. 8 shows a side view of a base of a wicket of a cricket game according to a preferred embodiment of the present invention.
Figure 9:
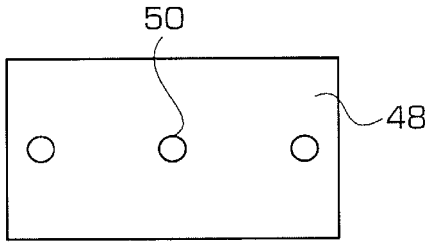
FIG. 9 shows a top view of a base of a wicket of a cricket game according to a preferred embodiment of the present invention.

The base 48 of the wicket 3 is approximately 1¼ inch L×1½ inch W, and is made of wood, a soft plastic, or other suitable material (see FIGS. 8–9). Small pins or brads 49 are used to nailed into the lower end portion of the stumps 46 from the bottom surface of the base 48 thereof, through the base 48, and to project through the top surface of the base 48. The brads 49 penetrate the stumps 46 to hold each of the stumps 46 in place on the base 48. Other methods may be used to hold the stumps 48 in place, such as providing holes 50 (see FIG. 9) in the base 48, into which the stumps 46 are placed.

The bat 44 used in the cricket game (see FIG. 6) is approximately 6 inches long, with the bat 44 being ¾ inches wide at the hitting surface 51, and 2 inches in length, and ¼ inch in diameter, at the grip 52. The bat 44 is preferably made from wood, but can be made of any suitable material, such as plastic, which can provide a non-slip hitting surface.

The ball 45 (see FIG. 6) used in the cricket game is a small rubber ball 45 the approximate size of a marble, or a marble itself. The ball 45 can also be made of plastic or any other suitable material.

FIG. 6 shows the cricket game with a portion of the player cards 27 set up around the matting 43 which represents the cricket pitch. The player cards 27 are held up by their bases 34, with one of the two wickets 3 shown at end A (i.e., there are two opposite ends, end A and end B) of the cricket pitch.

In setting up the player cards 27, an approximate distance in scale is used for each of the player cards 27 from the wickets 3. However, for the silly mid-off 10 and silly mid-on 11 player cards, their positions should be at least 8 inches away from the batsman 1 at end A of the cricket pitch. Further, boundaries should be at least 4 inches away from the wickets 3.

As stated above, the dimensions of any of the structures provided may be changed, depending on the scale of the playing surface used.

The cricket game is played using well known rules of cricket, as for instance, codified in the latest Code of the Laws of Cricket, published by the Marylebone Cricket Club, England.

The first player, which plays for the first side, plays as batsman 1, by either sitting down or bending down behind the wicket 3 behind batsman 1 at end A of the cricket pitch.

The second player, who plays for the second side, acts as the bowler, and bends down or sits down behind the bowler player card 4 at end B of the cricket pitch.

The second player/bowler then bowls the ball 45 to the first player/batsman, and the first player/batsman, hits the ball 45 with the bat 44, and the game is played like any real cricket game.

FIG. 1 shows a scoring diagram which overlays the positions of the players on the cricket field, and which depicts the possible runs to be made by the batsman 1 depending on which direction he hits the ball 45, and to what distance. Each trajectory from the batsman's 1 position means a different number of runs for batsman 1, from 1 to 6 runs, as well as each position along each trajectory, within each ring, means a different number of runs, from 1 to 6 runs. In each scoring trajectory/ring, the ball 45 passes the player card 27 without hitting it.

For example, if the ball 45 thrown by the first player touches the batsman 1 at end A of the cricket pitch, and goes past the wicket keeper 5, and hits the first player, that is 4 runs. A ball 45 hit in the vicinity of the leg slip 19 is one run, and past the leg slip 18 on the same trajectory, is 2 runs. Specifically, any ball 45 which touches the bat 44, that does not pass the first ring of fielders (i.e., field positions silly mid-off 10, silly mid-on 11 etc.), is 1 run. A ball hit towards the batsman 2, past the mid-on 14, or to the boundary, is 4 runs, etc. A ball 45 hit in the air to the boundary is 6 runs (i.e., as shown in FIG. 1, between the short leg 11/mid-wicket 12 and the square leg 8).

In addition to the scoring diagram shown in FIG. 1, a written instruction pamphlet 53 (see FIG. 10) is provided, which includes, at the very least, the following rules special to the present cricket board game. The scoring diagram of FIG. 1 can also be contained in the written instruction pamphlet 53, or provided separately. The special rules follow.

For instance, the second player/bowler's hand should not cross the cricket pitch while delivering the ball 45, as this would be 1 extra (i.e., a run) to the batting side (i.e., first player).

If the second player/bowler 4 hits the fingers of the first player/batsman 1 after bowling the ball 45, it will be 4 extras (i.e., 4 runs) to the first player/batsman 1.

While the first player/batsman 1 is batting, any player card 27 that is hit down with the ball 45 shall be out (caught). If the second player/bowler 4 hits the wicket 3 while bowling, the first player's batsman 1 is out.

Figure 10:
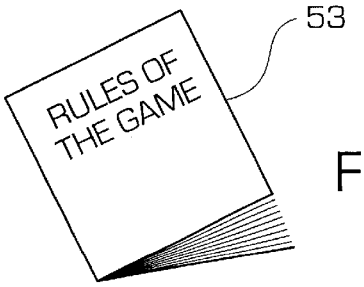
FIG. 10 shows a perspective view of a written instruction pamphlet for the cricket board game according to a preferred embodiment of the present invention.

As with a normal cricket game, each bowler 4 will bowl 6 balls per over, preferably alternating from fast to spin, and final scoring, using the scoring diagram of FIG. 1 and the instruction pamphlet of FIG. 10, will be in accordance with the final scores of a normal cricket game.

Although the game is played by two persons, a third person and/or fourth person can play as the second batsman 2 and/or one of the umpires 25, 26, respectively.

Although the invention has been described in detail with reference to particular embodiments thereof, this description is not meant to be construed in a limiting sense. Various modifications of the disclosed embodiments, as well as alternative embodiments of the invention, will become apparent to persons skilled in the art upon reading the foregoing. It is therefore contemplated that such modifications can be made without departing from the scope of the present invention as defined in the appended claims.

What is claimed is:

1. An apparatus for a cricket board game, comprising:

a ball;

a bat for hitting said ball;

means for depicting cricket players of said game;

individual means for holding said respective depicting means in a transiently supported manner, such that said ball displaces said depicting means from said holding means upon contact of said ball with said depicting means; and means for scoring said game.

2. The apparatus for a cricket board game as claimed in claim 1, wherein said ball is either one of plastic and rubber.

3. The apparatus for a cricket board game as claimed in claim 1, wherein said ball is a marble.

4. The apparatus for a cricket board game as claimed in claim 1, wherein said bat is made of one of wood and plastic.

5. The apparatus for a cricket board game as claimed in claim 1, wherein said holding means includes one of a square, a triangular, and an L-shaped base.

6. An apparatus for a cricket board game, comprising:

a ball;

a bat;

a plurality of player cards;

a plurality of holders, each which holds one of said player cards in a transiently supported manner, such that said ball displaces one of said player cards from said respective one of the holders upon contact of said ball with said one of said player cards; and a scoring diagram for scoring said cricket game.

7. The apparatus for a cricket board game according to claim 6, said cricket board game further comprising:

a matting which represents a cricket pitch.

8. The apparatus for a cricket board game as claimed in claim 7, further comprising two wickets which are placed at opposite ends of said cricket pitch.

9. The apparatus for a cricket board game as claimed in claim 8, wherein each of said wickets comprises:

a first, a second, and a third stump;

a base in which said three stumps are disposed; and a first bail and a second bail, said first bail disposed between said first and said second stump, and said second bail disposed between said second and said third stump.

10. The apparatus for a cricket board game as claimed in claim 9, wherein said base is provided with three holes, in which said first, said second and said third stump are disposed, respectively.

11. The apparatus for a cricket board game as claimed in claim 9, wherein three brads are inserted into a bottom surface of said base, and project through a top surface of said base, such that said brads penetrate respectively into said first, said second, and said third stump, to hold said first, said second, and said third stump steady in place.

12. The apparatus for a cricket board game as claimed in claim 7, wherein said mat is made of plastic.

13. The apparatus for a cricket board game as claimed in claim 6, wherein said player cards have two side surfaces, and one side of said two side surfaces includes at least one of photographic and pictorial representations of current, past, and fictional cricket players, and a written description of said cricket players.

14. The apparatus for a cricket board game as claimed in claim 13, wherein another side of said two side surfaces of said player cards has one of a logo, pictorial representation, photographic representation, graphic design, and written description.

15. The apparatus for a cricket board game as claimed in claim 6, wherein said player cards have two side surfaces, and at least one side of said two side surfaces of said player cards is blank.

16. The apparatus for a cricket board game as claimed in one of claims 13 or 15, further comprising means for fastening one of photographic and pictorial representations of current, past, and fictional cricket players, and a written description of said cricket players to said one side blank surface of said two side surfaces of said player cards.

17. The apparatus for a cricket board game as claimed in claim 15, wherein said one side surface of said two side surfaces includes at least one of photographic and pictorial representations of current, past, and fictional cricket players, and a written description of said cricket players.

18. The apparatus for a cricket board game as claimed in claim 17, wherein another side of said two side surfaces of said player cards has one of a logo, pictorial representation, photographic representation, graphic design, and written description.

19. The apparatus for a cricket board game as claimed in claim 6, wherein said scoring diagram provides for scoring of runs depending upon a trajectory and a distance of said ball after being hit by said bat.

20. The apparatus for a cricket board game as claimed in claim 6, wherein said player cards are set up corresponding to players on a cricket field, and said scoring diagram is overlaid said cricket field and provides four concentric rings corresponding to one run, two runs, four runs, and six runs, respectively, radiating outwardly from a center portion of said cricket field, such that when said ball contacts an area one of inside and outside said rings, the corresponding number of runs is scored.

21. The apparatus for a cricket board game as claimed in claim 6, further comprising a written instruction pamphlet, including rules of the cricket game.

22. The apparatus for a cricket board game as claimed in claim 21, wherein said scoring diagram is provided in said written instruction pamphlet.

23. An apparatus for a cricket board game to be played on a flat surface representing a cricket field, said cricket board game comprising:

a ball;

a bat for hitting said ball;

a matting representing a cricket pitch on said cricket field;

a plurality of wickets disposed on said matting;

a plurality of player cards depicting cricket players of said game, said player cards disposed in positions on said cricket field representing two opposing cricket teams;

individual means for holding said player cards in a transiently supported manner, such that said ball displaces said one of said respective player cards from one of said respective holding means upon contact of said ball with said one of said player cards; and a scoring diagram for scoring said game, said scoring diagram which exhibits an overlay of a plurality of concentric rings, radiating outwardly from a center portion of said cricket pitch, each of said concentric rings corresponding to a different number of runs, a maximum number of said runs being six runs, and said rings which score the game according to a position at which said ball contacts one of inside and outside said rings of said cricket pitch.

* * * * *